United States Patent [19]

Salmela et al.

[11] Patent Number: 4,895,315

[45] Date of Patent: Jan. 23, 1990

[54] METHOD FOR REELING A WEB OF MATERIAL AND AN APPARATUS FOR IT

[75] Inventors: Jouko J. Salmela, Turku; Jukka Hietanen; Timo Syrjänen, both of Heinola, all of Finland

[73] Assignee: Heinolan Newtec OY, Finland

[21] Appl. No.: 389,478

[22] Filed: Jun. 17, 1982

[30] Foreign Application Priority Data

Jun. 18, 1981 [FI] Finland ..... 811931

[51] Int. Cl.[4] ..... B65H 18/20; B65H 35/02; B31C 1/00

[52] U.S. Cl. ..... 242/66; 242/56.2; 493/303

[58] Field of Search ..... 242/66, 56.2, 56.4, 242/56.5; 493/276, 303; 206/398, 411

[56] References Cited

U.S. PATENT DOCUMENTS

| | | | |
|---|---|---|---|
| 661,151 | 11/1900 | McCausland | 493/276 X |
| 1,426,879 | 8/1922 | Kreher | 493/276 |
| 1,646,479 | 10/1927 | Frederick | 493/303 X |
| 1,790,909 | 2/1931 | Frostad | 493/303 X |
| 2,428,385 | 10/1947 | Reynolds | 242/66 X |
| 2,772,774 | 12/1956 | Rabuse | 206/411 X |
| 2,984,426 | 5/1961 | Johnson | 242/66 X |
| 3,030,042 | 4/1962 | Gelleke | 242/66 X |
| 3,603,521 | 9/1971 | Ormsby | 242/56.2 |
| 3,841,578 | 10/1974 | Dorfel | 242/66 |
| 4,128,213 | 12/1978 | Komulainen | 242/66 |
| 4,238,082 | 12/1980 | Lund | 242/56.4 X |

FOREIGN PATENT DOCUMENTS

| | | |
|---|---|---|
| 704397 | 2/1954 | United Kingdom . |
| 991368 | 5/1965 | United Kingdom . |
| 1174634 | 12/1969 | United Kingdom . |
| 1554619 | 10/1979 | United Kingdom . |

*Primary Examiner*—Harvey C. Hornsby
*Assistant Examiner*—Scott J. Haugland
*Attorney, Agent, or Firm*—Roylance, Abrams, Berdo & Goodman

[57] ABSTRACT

The invention relates to a method and apparatus for reeling a web of material onto a core by glueing the leading end of the web of material to the core and by rotating the core until the roll is of the desired thickness, by cutting off the web of material and by attaching the trailing end of the cut-off web of material to the roll. The method uses a core base onto which so many layers of the web of material are glued that the thickness, and thereby the strength, of the thus formed core is sufficient for reeling and for the further handling of the roll.

The invention also relates to a roll of a web of material, around which there is a wrapping composed of at least two layers of the web of material, glued to each other, and to a method of forming such a wrapping during the reeling of the web of material.

18 Claims, 1 Drawing Sheet

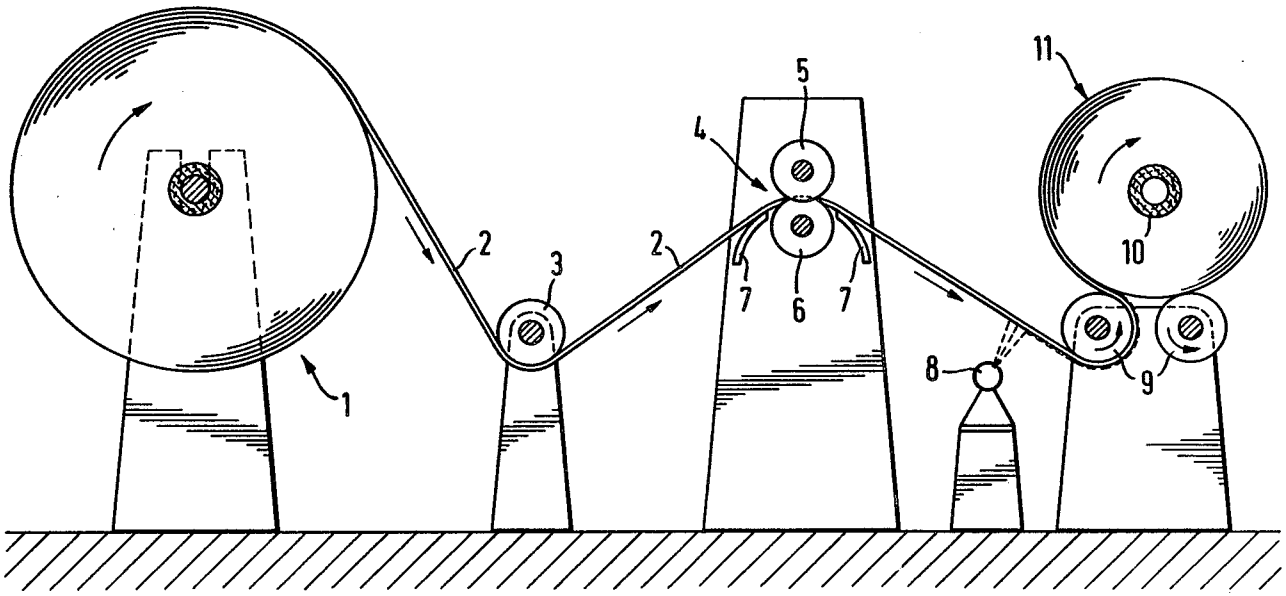
1
2
2
3
4
5
6
7
7
8
9
10
11

METHOD FOR REELING A WEB OF MATERIAL AND AN APPARATUS FOR IT

BACKGROUND OF THE INVENTION

The present invention relates to a method for reeling a web of material, especially a paper web, onto a core, for example a spiral core, by glueing the leading end of the web of material to the core and by rotating the core until the roll is of the desired thickness, by cutting off the web of material, and by attaching the trailing end of the cut-off web to the roll. The invention relates in particular to the reeling, onto a core, of a web of material coming from unreeling frames, slitting machines or sheet cutters. In addition, the invention relates to an apparatus for carrying out the method according to the invention. At the same time the invention relates to a roll of a web of material, which is surrounded by a wrapping protecting and supporting the roll, and to a method for forming such a wrapping during the reeling.

It is previously known to reel a paper web coming from a slitting machine or a sheet cutter onto a core by attaching the leading end of the web to the core manually by using various means such as masking tape, staples and the like. The trailing end of the paper web has also been attached to the roll manually using masking tape or by applying glue to the trailing end of the web by means of a brush.

The length of the web of material reeled onto a core, and thereby also the thickness of the completed roll, varies, and therefore the core is subjected to strains of varying intensity during the reeling and during the further handling subsequent to the reeling, such as moving of the rolls and unreeling. Thus, cores of different thicknesses and different strengths are required for these different needs. In addition, it has been observed that especially the ends of the cores are subjected to greater than normal strains during the transportation or handling of the rolls, and for this reason it is common to fit a peg at one or both ends of the hollow in the core. Alternatively, the ends of the cores are provided with sleeves in order to reinforce the cores.

The object of the present invention is to eliminate these disadvantages and to provide a method and apparatus for reeling a web of material onto a core, which does not require any pegs or sleeves for reinforcing the ends of the core nor cores of different strength, depending on the reeling speed, the roll thickness or the further handling of the roll. The object of the present invention is thus to provide a method for reeling webs of material of different lengths at different speeds onto cores of one and the same size by glueing the leading end of the web of material to the core and by rotating the core until the roll is of the desired thickness, by cutting off the web of material, and by attaching the trailing end of the cut-off web of material to the roll. The object of the invention is, furthermore, to provide a roll of a web of material surrounded by a wrapping which protects and supports the roll as well as a method for attaching the trailing end of the cut-off web of material to the roll, the method enabling a very strong wrapping, which protects and supports the roll, to be produced.

The object of the invention is finally to provide reeling apparatus intended to be installed at a point subsequent to a slitting machine or a sheet cutter or an unreeling device.

It is previously known to form the core so as to form one unit with the web of material which is reeled onto it. In this case, several rounds of the web of material are reeled onto the reeling spindle, the rounds being at the same time glued to each other to produce a core, whereafter the reeling is continued directly without glueing. However, this method of reeling requires the use of a special reeling spindle, and it cannot be applied to spindle-less reeling, which is currently favored. Furthermore, the reeling spindle must be an expansion shaft, because otherwise it would not be possible to remove it from the center of the roll. Finally it should be noted that in slitting machines it is not possible to use this prior known method of reeling, since a slitting machine does not have spindles.

According to the invention there is now provided a method which starts from a relatively weak core base which is of low quality and therefore inexpensive, and then so many layers of the web of material are glued onto it that the thickness of the thus created core, and thereby its strength, is sufficient for reeling and the further handling of the roll.

Within the same inventional idea it is possible to attach the trailing end of a cut-off web of material to the roll by starting the applying of the glue in good time before the cutting off of the web of material so that there is formed around the roll a wrapping consisting of several layers glued to each other, protecting and supporting the roll.

It has been surprisingly observed that a glued core prepared by the method according to the invention is far more durable than a spiral core of the same thickness and size. Furthermore, the surface of a glued core prepared according to the invention is much smoother, and therefore it is possible to use the leading end of the paper web much more efficiently, i.e. less reject produced during unreeling. Effective glueing of the trailing end of the paper web to the roll also reduces reject during the transportation and further handling of the roll. This means improved safety at work, since the floors keep clean.

The glueing members used in the method and apparatus according to the invention can also be used for glueing together the ends of the parts of a web which has broken off, for joining several paper webs to each other by the ends, and for glueing several layers of paper to form multiple-layer paper using a paper of inferior quality in the intermediate layers. In addition, it is possible to connect to the glue-applying members moistening members for adjusting the moisture content of the paper web in its transversal profile, members for applying various additives to the surface of the paper web, and members for marking the paper web, for example for marking the paper web at some distance from its leading end so that at the unreeling stage it is known in advance how long unreeling can be continued before the paper web ends. All these are additional advantages, which also have great economical significance.

The primary advantage of the present invention is, however, the fact that one single core type can be used for all reeling purposes in practice, without having to lower the standards for the strength of the core and without having to use expensive and awkward pegs or sleeves at the ends or the core.

DESCRIPTION OF THE DRAWING

The invention is described below in greater detail with reference to the accompanying drawing, which depicts a side view of an apparatus usable for carrying out the method according to the invention, installed at a point subsequent to the slitting machine.

DESCRIPTION OF THE PREFERRED EMBODIMENT

In the drawing, the unreeling frame is indicated by reference numeral 1. The paper web coming from the unreeling frame is indicated by 2, and it runs below the guide roller 3 to the slitting machine 4. The slitting machine 4 comprises several cutting blades 5 fitted adjacently at intervals from each other on a mutual shaft and counter-blades 6 fitted below them, the paper web 2 being directed to between the blades by means of guide surfaces 7. The blades 5 and 6 slit the paper web 2 into several separate webs, which are reeled onto rolls 11 which are supported by bearing rollers 9 and inside which there is a core 10.

As seen in the travel direction of the paper web, there is fitted in front of the bearing rollers 9 a spraying device 8 extending across each slit web, and by means of this spraying device 8, glue or some other fluid material can be sprayed onto that side of the paper web which during the reeling faces inwards in the roll 11, i.e. towards the core 10.

The roll 11 is rotated by means of the bearing rollers 9, but it is evident that the roll 11 can also be rotated directly by means of rotating members supporting the core, in which case bearing rollers 9 are not necessary.

When reeling is started, the core base is fitted so as to be supported by the bearing rollers 9, and the leading end of the slit paper web is passed around the first bearing roller 9 and is attached to the core base by means of glue. The glue has in this case been applied over such a distance that it extends as far as the gluespraying device 8. Thereafter the rotation of the bearing rollers 9 is commenced and at the same time glue is sprayed from the spraying device 8, at which time the paper web is wound and glued around the core base. The reeling and glueing are continued until the thickness of the core base has grown large enough, i.e. to the thickness of the desired core base. Thereafter reeling is continued without spraying glue from the spraying device 8. By means of the spraying device 8 it is also possible to spray some other fluid substance onto the web, for example a color or water in order to moisten the web. Somewhat before the roll 11 has attained the desired thickness, the applying of glue is restarted by spraying glue from the spraying device 8 onto the web. Thereupon the trailing end of the paper web is glued to the roll 11. The web can be cut off either manually or by machine.

It is evident that the spraying device 8 depicted in the drawing can be replaced by other types of glueapplying members, such as a roller, a glue brush, a scraper or some other generally known glueapplying device fitted so as to be against the web surface. One advantageous solution is a single roller which is in part immersed in the glue trough.

What is claimed is:

1. A continuous method of reeling a web of material onto a core base in a spindle-less reeling system to form a roll and core of desired thickness, in situ, which comprises gluing the leading end of said web of material to a preformed core base, said preformed core base being supported by bearing rollers, said core base having insufficient strength and thickness to support the roll of desired thickness, continuing gluing and rolling sufficient rounds of said web of material onto said core base such that the thickness of the core thus formed in situ, and thereby its strength, is sufficient for reeling the remainder of the roll and further handling of the roll, said core comprising said preformed core base having said sufficient rounds of said web of material glued thereto, discontinuing gluing while continuously rolling additional rounds of said web of material until the roll is of the desired thickness, cutting off the web of material, and attaching the trailing end of the web of material to the roll.

2. The method according to claim 1 wherein reeling is commenced by applying the glue to the leading end of a slit paper web from a glue spraying device, and the core base is then rotated with continued gluing and reeling of the web to form said core of desired thickness.

3. The method of claim 2 wherein said core base is a spiral core.

4. The method according to claim 1 wherein said glue that is applied prior to cutting off said web of material is applied such that at least two layers of the web of material are glued to each other.

5. The method according to claim 1 wherein said glue that is applied prior to cutting off the web is applied to the surface of the web that faces inward towards the core.

6. The method of claim 1 wherein said web is a paper web.

7. The method of claim 1 wherein glueing is restarted sufficiently prior to the cutting off of the web of material and continuously applying glue such that at least two layers of said web of material forms a wrapping around the roll which protects and supports the roll.

8. The method of claim 1 wherein the glue is applied to the web in a continuous manner across the entire width of the web.

9. The method of claim 1 wherein said leading end of said web of material is obtained from a slitting machine comprising several cutting blades fitted adjacently at intervals from each other to separate a paper web into several separate webs, one of said separate webs providing said leading end.

10. The method of claim 1 wherein glue is applied across the entire surface of said paper web.

11. The method of claim 10 wherein said glue is applied by spraying.

12. The method of claim 1 wherein said core base is formed of a fibrous material.

13. The roll of claim 1 wherein said core base is formed of a non-metallic material.

14. The roll of claim 13 wherein said core base is formed of a fibrous material and is a spiral core base.

15. A roll comprising rounds of homogeneous web material, a sturdy wrapping provided around rounds of unglued web material protecting and supporting said rounds of unglued web material; said wrapping consisting of at least two of the outermost layers of said homogeneous web material glued to each other over their entire surfaces.

16. The roll of claim 15 wherein said roll comprises a spiral core base of insufficient strength to support said roll, rounds of web material glued to said core base in sufficient amounts to form a core of sufficient strength to support said roll, and unglued rounds of said web of material supported by said core.

17. The web of claim 16 wherein said glued and unglued rounds of web material are continuous.

18. The roll of claim 15 wherein said glued and unglued rounds of web material are continuous.

* * * * *